US011752443B1

(12) United States Patent
Snider

(10) Patent No.: US 11,752,443 B1
(45) **Date of Patent: *Sep. 12, 2023**

(54) INFLATABLE LAUNCHABLE TOY SYSTEM

(71) Applicant: Andrew C. Snider, Portland, OR (US)

(72) Inventor: Andrew C. Snider, Portland, OR (US)

( * ) Notice: Subject to any disclaimer, the term of this patent is extended or adjusted under 35 U.S.C. 154(b) by 66 days.

This patent is subject to a terminal disclaimer.

(21) Appl. No.: 17/073,858

(22) Filed: Oct. 19, 2020

(51) Int. Cl.

| | |
|---|---|
| ***F41B 3/02*** | (2006.01) |
| ***A63H 27/10*** | (2006.01) |
| ***A63H 27/14*** | (2006.01) |
| ***A63H 33/18*** | (2006.01) |
| ***A63H 27/00*** | (2006.01) |

(52) U.S. Cl.
CPC ..... *A63H 27/14* (2013.01); *A63H 27/001* (2013.01); *A63H 27/005* (2013.01); *A63H 33/18* (2013.01); *F41B 3/02* (2013.01)

(58) Field of Classification Search
CPC ..... A63H 27/10; A63H 2027/1025; A63B 41/00; A63B 41/02; A63B 41/10; F41B 3/02
See application file for complete search history.

(56) References Cited

U.S. PATENT DOCUMENTS

| | | | | |
|---|---|---|---|---|
| 3,721,591 | A * | 3/1973 | Crook | A63B 41/00 156/93 |
| 4,834,382 | A | 5/1989 | Spector | |
| 5,282,453 | A | 2/1994 | Chia | |
| 5,579,749 | A | 12/1996 | Wilkinson | |
| 6,500,042 | B1 | 12/2002 | LaPointe | |
| 8,689,773 | B2 | 4/2014 | Walterscheid et al. | |
| 8,991,373 | B2 | 3/2015 | Cummings | |
| 9,310,171 | B2 | 4/2016 | Cummings | |
| 9,903,681 | B2 | 2/2018 | Walterscheid et al. | |
| 10,807,012 | B1 * | 10/2020 | Snider | A63H 27/001 |
| 2003/0064658 | A1 | 4/2003 | Zheng | |
| 2007/0123140 | A1 * | 5/2007 | Bonsembiante | A63H 27/10 446/220 |
| 2008/0045117 | A1 * | 2/2008 | Marin Hernandez | A63H 27/10 446/220 |
| 2012/0125266 | A1 | 5/2012 | Ying | |
| 2016/0303459 | A1 | 4/2016 | Martino | |

* cited by examiner

*Primary Examiner* — John A Ricci

(74) *Attorney, Agent, or Firm* — Rylander & Associates, PC; Philip R. M. Hunt

(57) ABSTRACT

An inflatable launchable toy system comprising a launcher and an inflatable launchable toy configured to detachably couple to the launcher. The launcher having a launcher handle and a launching elastic. The inflatable launchable toy comprises an outer fabric layer that is substantially airtight. A fabric seam joins edges of the airtight fabric layer. A launching hook is attached to the fabric seam. The outer fabric layer when inflated gives an intended shape to the inflatable launchable toy. The inflatable launchable toy configured to detachably couple to the launching elastic through the launching hook.

20 Claims, 10 Drawing Sheets

INFLATABLE LAUNCHABLE TOY SYSTEM

TECHNICAL FIELD

The present invention relates toys, specifically to launchable toys and systems for launching them.

BACKGROUND

There are several hand launched toys in existence today. Some are launched with an elastic launcher, by attaching the elastic launcher to the toy with a hook, pulling back the toy to strain the elastic launcher, then releasing the toy. All of the existing toys are made of solid shaft construction usually either plastic or foam with some sort of soft nose cone on the end. All of these toys share the same problems:

1. They are inherently not safe. The Consumer Product Safety Commission (CPSC) has continually increased the safety standards of hand launched projectiles.
2. All of the existing toy designs have design and size limitations. In order to fly, they must be dart shaped and relatively small. They will not work as large item or as detailed characters.

A need therefore exists for larger toys that can be hand thrown or launched with both great performance and inherent safety.

SUMMARY

An inflatable launchable toy system comprising an inflatable launchable toy and a launcher. The inflatable launchable toy comprises an outer fabric layer with an internal cavity that houses an inflatable bladder and a foam nose cone. The outer fabric layer establishes the geometry for the launchable toy and the added inflatable bladder when inflated, gives shape to the launchable toy. The fabric outer layer combined with the inflatable bladder and the foam nose cone makes the launchable toy incredibly safe. Because the inflatable bladder gives shape to the launchable toy, the launchable toy can be made very light. This reduces the force when the inflatable launchable toy impacts objects, making the launchable toy very safe. Additionally, the construction of the launchable toy allows for larger embodiments which allows the launchable toy to have a larger leading-edge which will easily meet the leading-edge diameter restrictions as established by the CPSC. Additionally, the inflatable bladder inside the fabric outer layer absorbs shock and softens the impact of the device.

The launchable toy can be either hand thrown or launched with a standard handheld launcher using a launching strap system integrated into the inflatable launchable toy. The inflatable launchable toy has a launching strap system coupled to the outer fabric layer, the launching strap system including a launching strap and a launching hook. The launching strap having a first end portion at one end, a second end portion at an opposite end and a middle portion, where the launching hook is coupled to the first end portion of the launching strap, where the second end portion of the launching strap has a strap handle. This unique launching system provides the ability to apply an incredible amount of force to the device without harming the integrity of the device.

In some embodiments, the outer fabric layer is substantially airtight and there is no separate inflatable bladder. A outer fabric seam joins edges of the airtight fabric layer. A launching hook is attached to the outer fabric seam. The outer fabric seam provides extra stiffness when a user pulls the inflatable launchable toy away from the launcher handle, stretching the launching elastic.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures.

DETAILED DESCRIPTION

In describing the one or more representative embodiments of the inventive subject matter, use of directional terms such as "upper," "lower," "above," "below", "in front of," "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business-related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. Any embodiment described as "comprising" includes the case of "consisting only of." The scope of the inventive subject matter should not be limited by the particular embodiments herein described but should be defined only by the appended claims and equivalents thereof.

First Representative Embodiment

Figure 1:
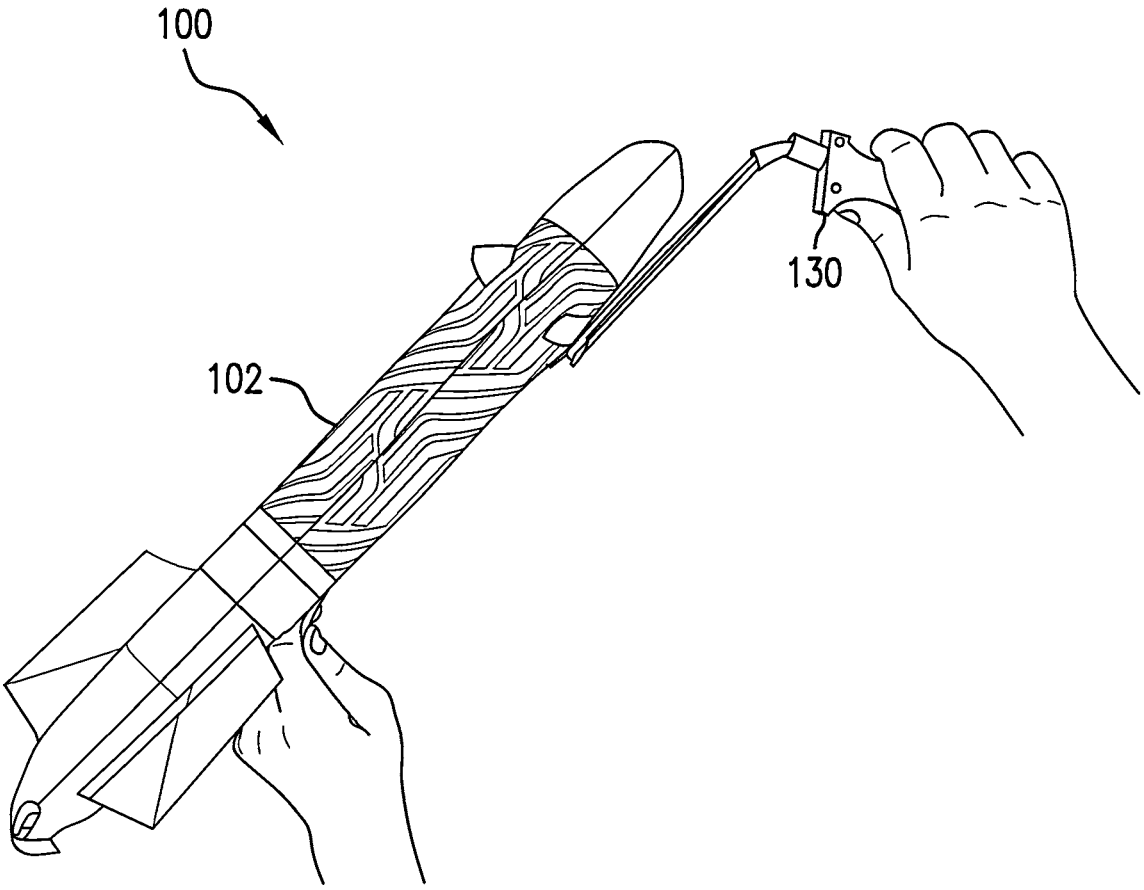
FIG. 1 shows side view of a first representative embodiment inflatable launchable toy system.

FIG. 1 shows side view of a first representative embodiment inflatable launchable toy system 100. The first representative embodiment inflatable launchable toy system 100 has an inflatable launchable toy 102 and a launcher 130. The launcher 130 is held by a user who engages the inflatable launchable toy 102 with the launcher 130, pulls the inflatable launchable toy 102 away from the launcher 130 to increase tension, then releases the inflatable launchable toy 102, causing the tension to be converted to kinetic energy propelling the inflatable launchable toy 102 forward.

Figure 2:
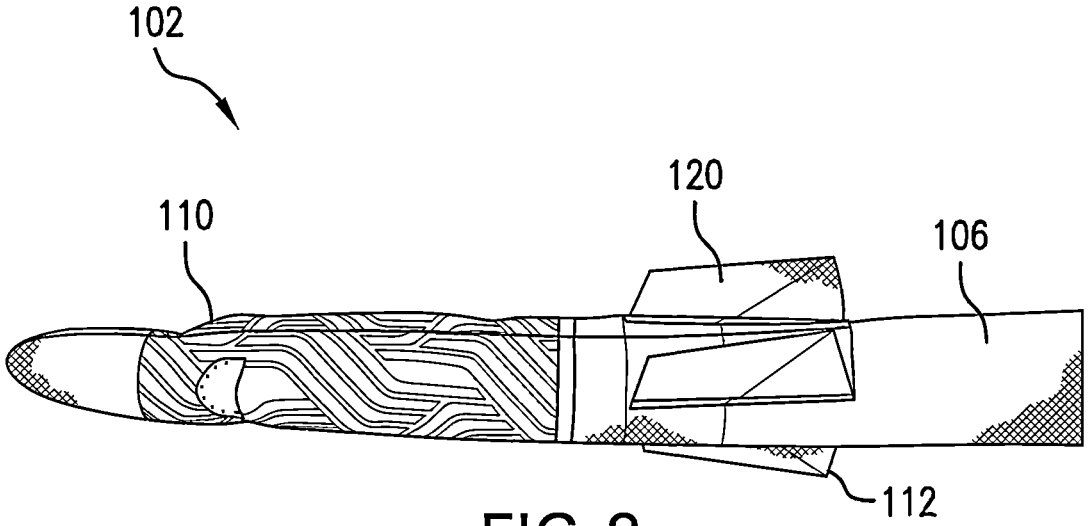
FIG. 2 shows a side view of a first representative embodiment inflatable launchable toy of the first representative embodiment inflatable launchable toy system.

FIG. 2 shows a side view of the first representative embodiment inflatable launchable toy 102. The first representative embodiment inflatable launchable toy 102 comprises an outer fabric layer 110 with an inflatable bladder 106 inside an internal cavity 112 of the outer fabric layer 110. The outer fabric layer 110 is the fabric on the outside of the device, typically comprising several pieces of fabric sewn together to create the geometry of the device. The fabric used for the fabric outer layer includes rip stop nylon and nylon webbing, but in alternative embodiments may comprises other suitable materials. The first representative embodiment inflatable launchable toy 102 is shown in the shape of a rocket, it may be in many different shapes and styles, including but not limited to: rockets, planes, superhero figures.

Figure 3:
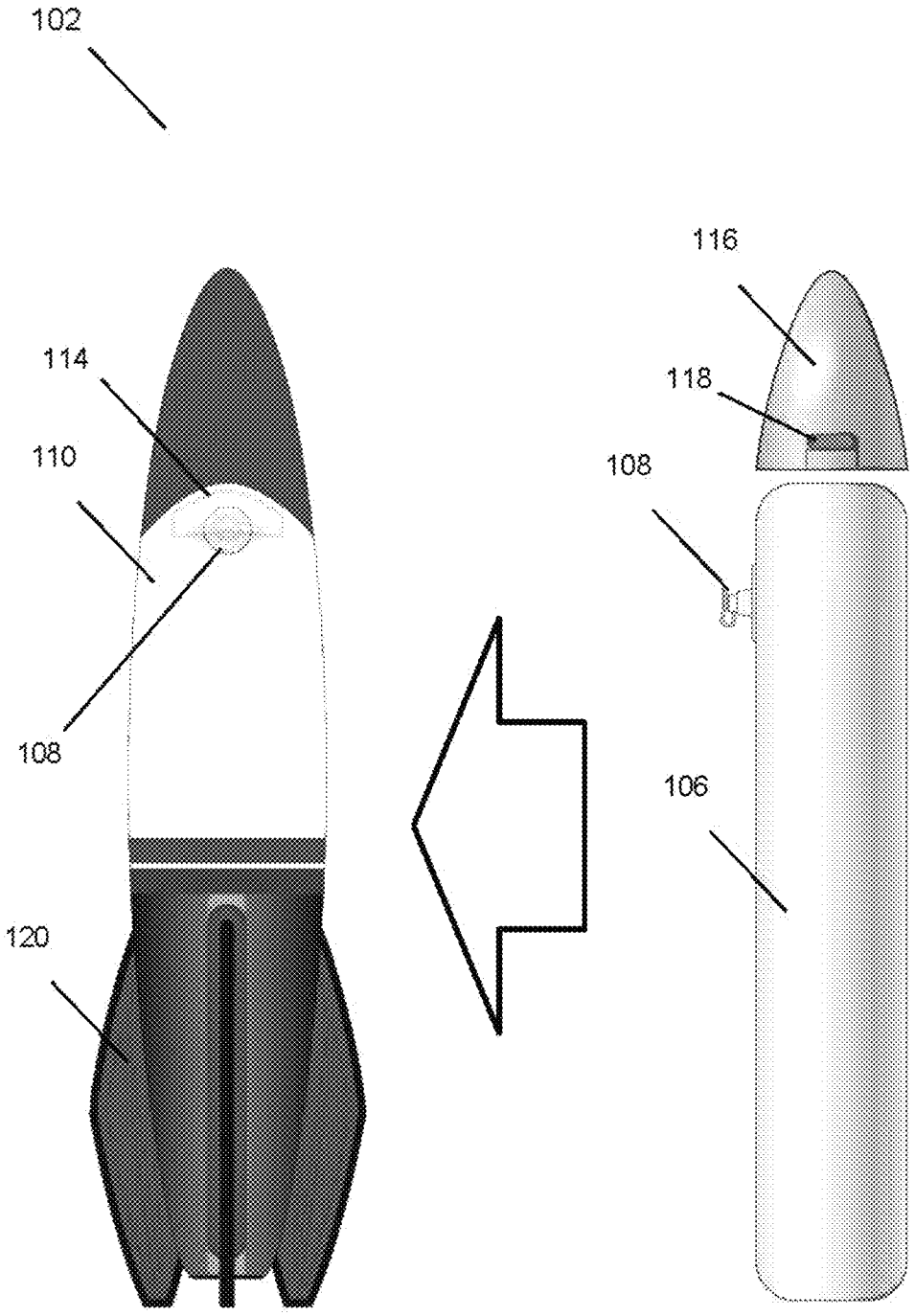
FIG. 3 shows a side view of the first representative embodiment inflatable launchable toy with its inflatable bladder and a foam nose cone removed from inside the internal cavity of the outer fabric layer and positioned alongside to the right.

FIG. 3 shows a side view of the first representative embodiment inflatable launchable toy 102 with its inflatable bladder 106 and a foam nose cone 116 removed from inside the internal cavity 112 of the outer fabric layer 110 and positioned alongside to the right. The inflatable bladder 106 has a valve 108 for inflation and deflation. The valve 108 protrudes through a valve hole in the outer fabric layer 110 and at least a portion is covered by a hood 114. The hood 114 is attached to the outer fabric layer 110 forward of the valve hole in the outer fabric layer 110 for the valve 108. The shape of the outer fabric layer 110 is what gives the inflatable launchable toy 102 its geometry when inflated. The inflatable bladder 106 when inflated fills the internal cavity 112 to reveal the intended geometry of the inflatable launchable toy 102 and give it shape.

The inflatable bladder 106 is heat sealed polyurethane (PU) or similar material that is flexible and durable. This material will stretch and return to shape. The inflatable bladder 106 is constructed by combining two thin sheets of polyurethane plastic and heat sealing into the shape desired. A hole is then cut and the valve 108 is glued in. The inflatable bladder 106 can be a general shape such as a square or rectangle. The inflatable bladder 106 can be larger than the internal cavity 112 of the outer fabric layer 110. When the inflatable bladder 106 is inflated, the inflatable bladder 106 will expand to fill the entire internal cavity 112 of the outer fabric layer 110 and give the inflatable launchable toy 102 a shape intended by its designer. In the embodiment of a rocket, the inflatable bladder 106 fills the shaft. In the case of a plane, the inflatable bladder 106 may fill the wings and plane body. In the case of a figure (such as a superhero), the inflatable bladder 106 would fill the body of the figure. The inflatable bladder 106 is independent of the outer fabric layer 110 and can be easily and separately replaced.

The foam nose cone 116 comprises foam or a soft foam like material. The foam nose cone 116 acts as both a weighted front end for flight and a soft leading edge for safety. The foam nose cone 116 is positioned inside the internal cavity 112 of the outer fabric layer 110 in front of the inflatable bladder 106. In some alternative embodiments, the foam nose cone 116 may be on the outside of the outer fabric layer 110. In either case the foam nose cone 116 is attached to the outer fabric layer 110.

Furthermore, a weight 118 can be added in or under the foam nose cone 116 to provide additional weight for improved flight stability and performance. This weight 118 is typically either metal or some sort of rubber material.

The first representative embodiment inflatable launchable toy 102 also has a plurality of fins 120. These fins 120 are typically light, stiff material that is either sewn into the outer fabric layer 110 or attached to the outer fabric layer 110. In either case, the fins 120 become part of the outer fabric layer 110.

Figure 4A:
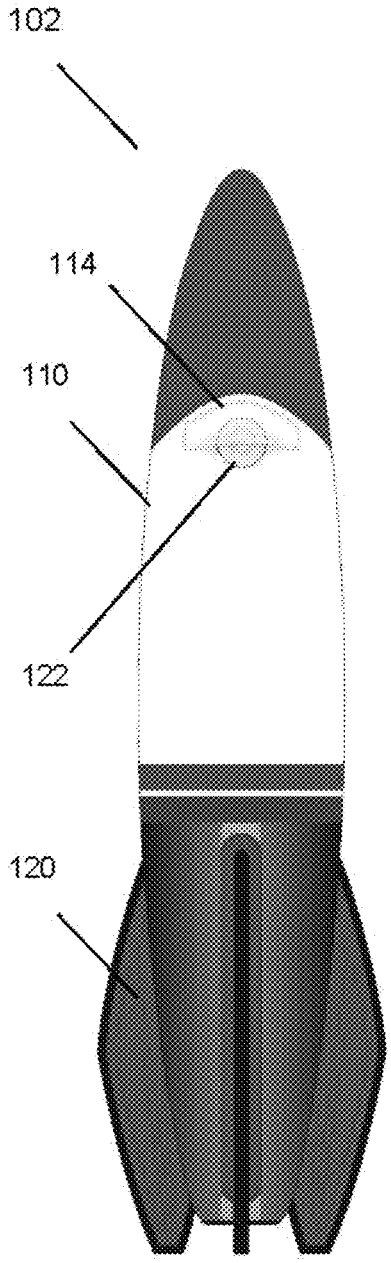
FIG. 4A shows a front view of the first representative embodiment inflatable launchable toy.
Figure 4B:
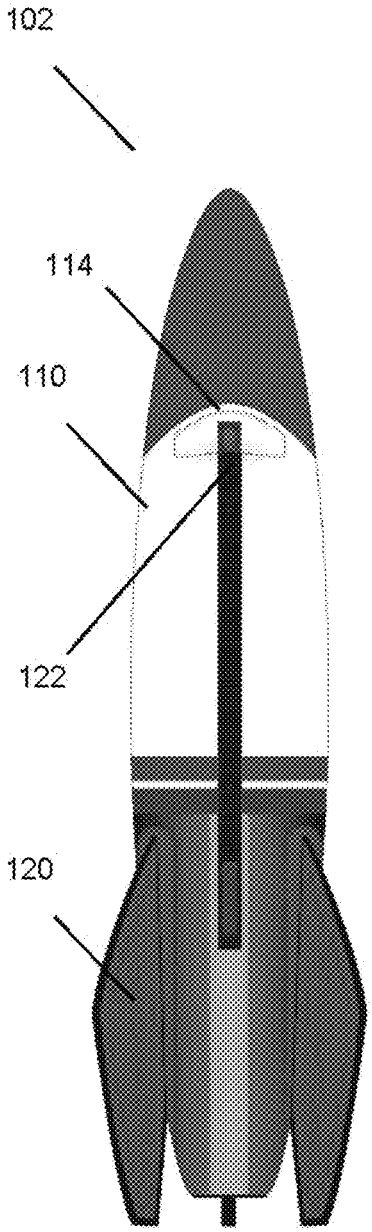
FIG. 4B shows a back view of the first representative embodiment inflatable launchable toy including a launching strap system.
Figure 5A:
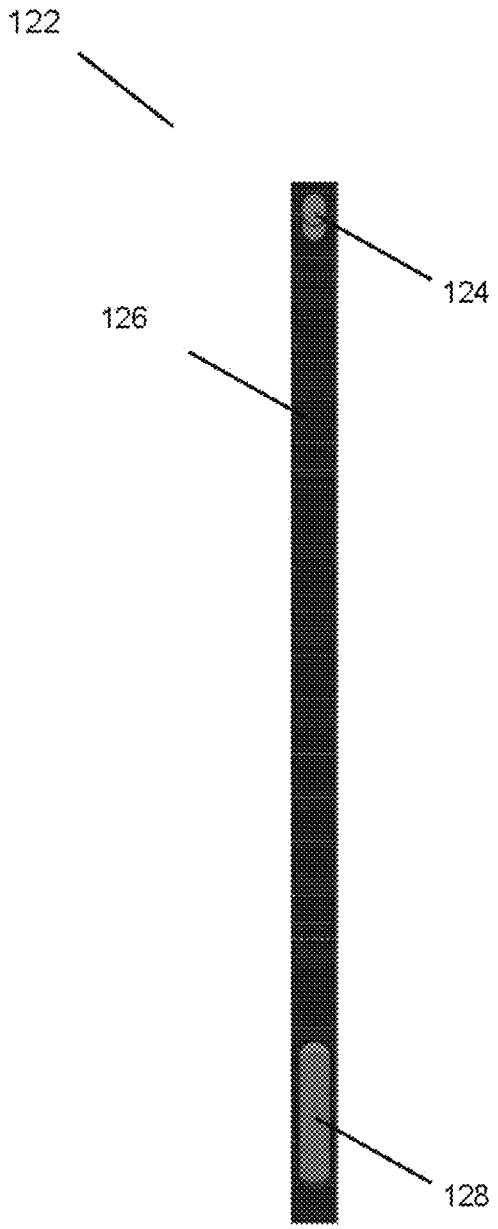
FIG. 5A shows a front view of the launching strap system.
Figure 5B:
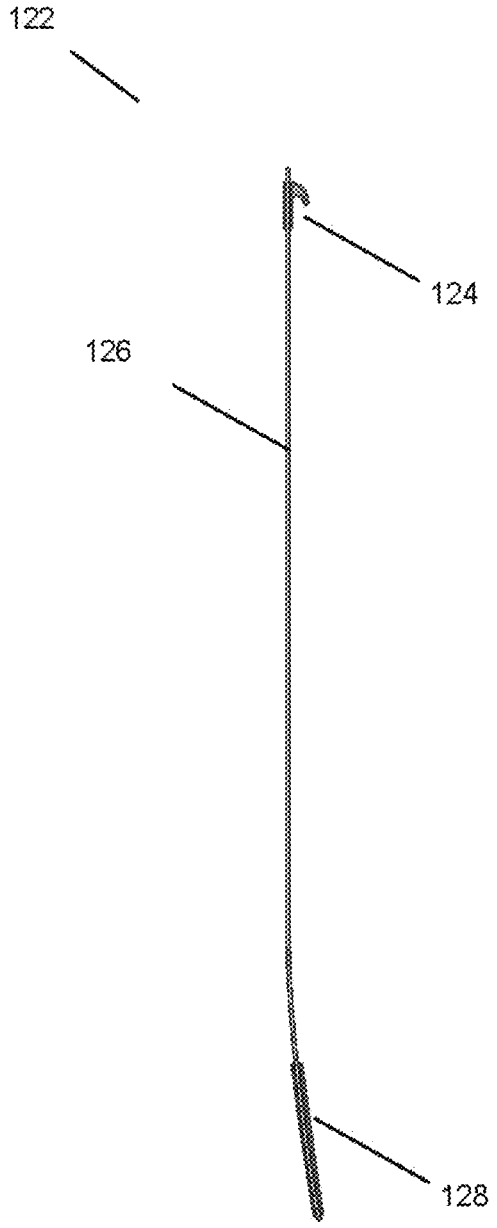
FIG. 5B shows a side view of the launching strap system.

FIG. 4A shows a front view of the first representative embodiment inflatable launchable toy 102 and FIG. 4B shows a back view of the first representative embodiment inflatable launchable toy 102 including a launching strap system 122. FIG. 5A shows a front view of the launching strap system 122 and FIG. 5B shows a back view of the launching strap system 122. The launching strap system 122 comprises a launching strap 126 and a launching hook 124. The launching strap 126 has a first portion at one end, a second portion at an opposite end and a middle portion in-between. The launching hook 124 is coupled to the first portion of the launching strap 126. The second portion of the launching strap 126 has a strap handle 128. The launching strap 126 comprises of a piece of non-stretch nylon webbing or similar material. The launching hook 124 is typically plastic but may comprise other suitable materials in alternative embodiments. (further known as launching system). The strap handle 128 is designed to be grabbed by the user and has finished handle-like details. The launching strap system is coupled to the outer fabric layer 110 by the first portion and the middle portion of the launching strap 126, but not the second end portion with the strap handle 128.

The launching strap system 122 is attached to the outer fabric layer 110 of the device, typically by sewing or gluing. Most of the launching strap 126 is attached to the outer fabric layer 110, which distributes the launching forces transmitted from the launching strap system 122 to the outer fabric layer 110 during launch. At least a portion of the launching hook 124 is covered by a hood 114. The hood 114 is attached to the outer fabric layer 110 forward of the launching hook 124. The launching hook 124 is on the exact opposite side of the first representative embodiment inflatable launchable toy 102 from the valve 108, as are the hoods 114 covering them. This arrangement provides weight balance and aerodynamic symmetry to the first representative embodiment inflatable launchable toy 102.

Figure 6:
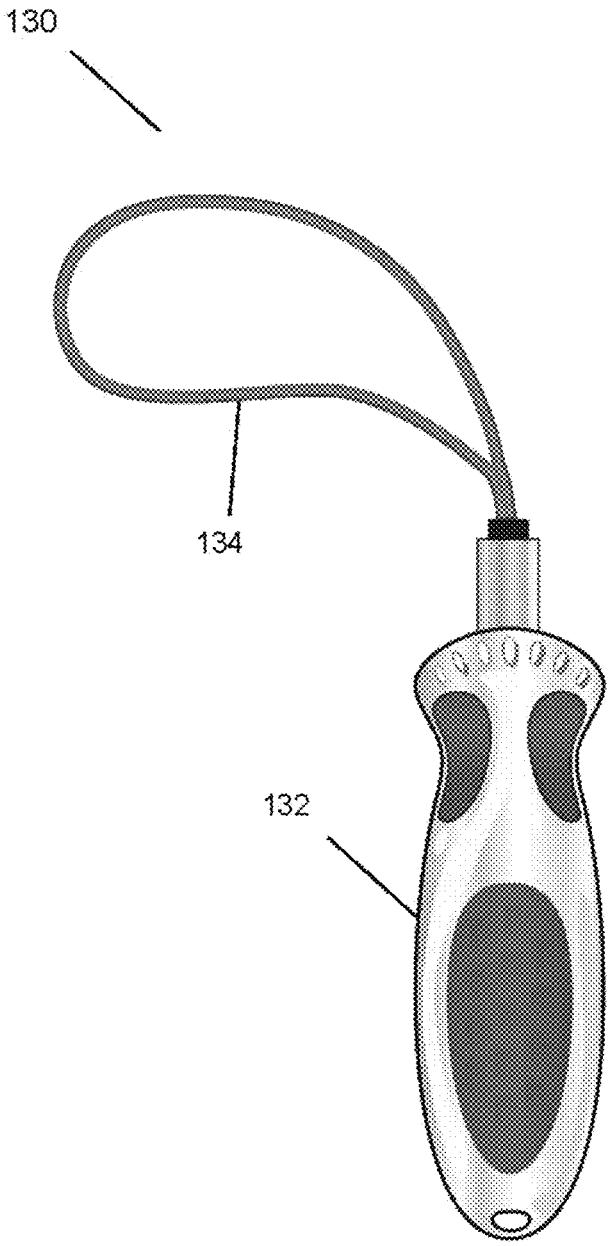
FIG. 6 shows a launcher of the first representative embodiment inflatable launchable toy system.

FIG. 6 depicts a launcher 130 of the first representative embodiment inflatable launchable toy system 100. The launcher 130 consists of a launcher handle 132 and a launching elastic 134 coupled thereto. The launching elastic 134 comprises an elastic or shock cord stretchy material. The launching elastic 134 which detachably couples with the launching hook 124 on the launching strap system 122 of the first representative embodiment inflatable launchable toy 102.

Second Representative Embodiment

Figure 7:
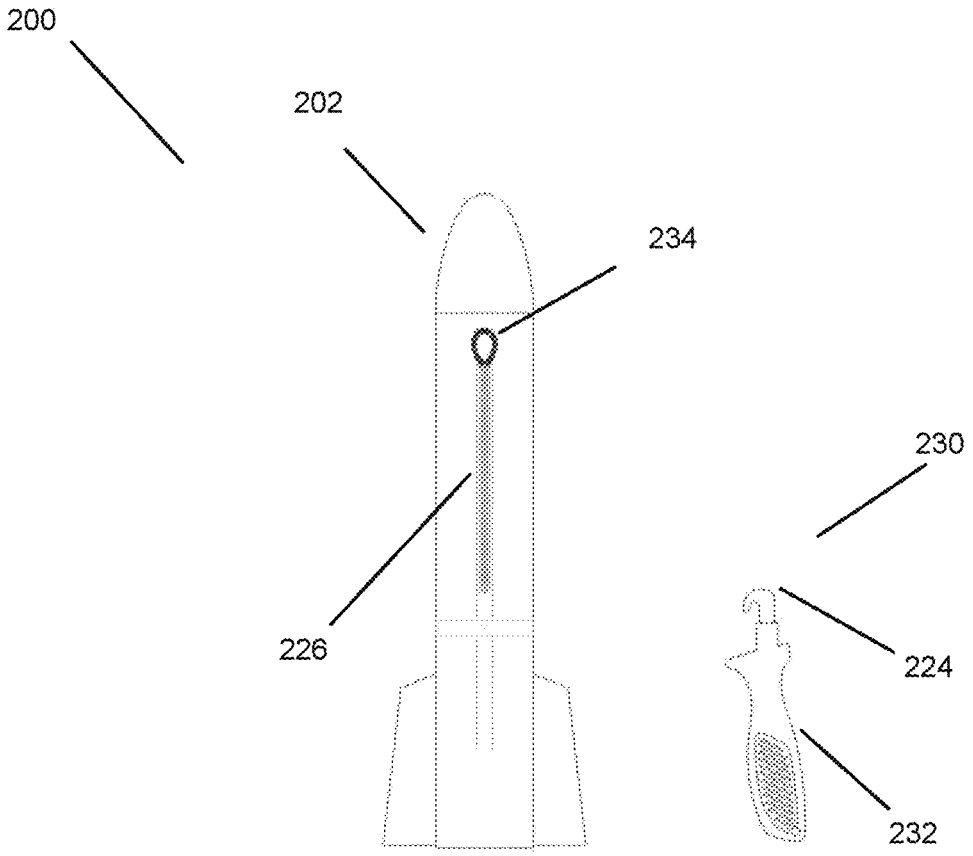
FIG. 7 shows a second representative embodiment inflatable launchable toy system.

FIG. 7 shows a second representative embodiment inflatable launchable toy system 200. In the second embodiment system 200, the launching elastic 134 is not part of a launcher 230 and the launching hook 124 is not part of an inflatable launchable toy 202, but instead the inflatable launchable toy 202 has an launching elastic 234 coupled to a launching strap 226 and the launcher 230 has a launching hook 224 coupled to a launcher handle 232. A user can use this alternative embodiment in a similar way as the first representative embodiment inflatable launchable toy system 100, the necessary changes being made.

The intended use has a user grabbing the launcher handle 132 with one hand and attaches the launching elastic 134 to the launching hook 124. The user then pulls from the strap handle 128 of the launching strap system 122, applying tension to the launching elastic 134 and the launching strap 126. After the launching hook 124 becomes stiff and secure, further tension cause the launching elastic 134 to stretch and store elastic energy. All of the tension force applied to the launching elastic 134 is transmitted through the launching strap system 122 rather than the outer fabric layer 110 or inflatable bladder 106. The optimal length of the launching elastic 134 at full strain is the distance between the hands of a typical user where one hand is grabbing the strap handle 128 of the launching strap system 122 and the other hand is grabbing the launcher 130.

The length of the launching strap system 122 is independent of the size of the inflatable launchable toy 102. This allows a large inflatable launchable toy 102 (e.g. a 3-foot-tall rocket) to be hand launched with ease.

Third Representative Embodiment

Figure 8:
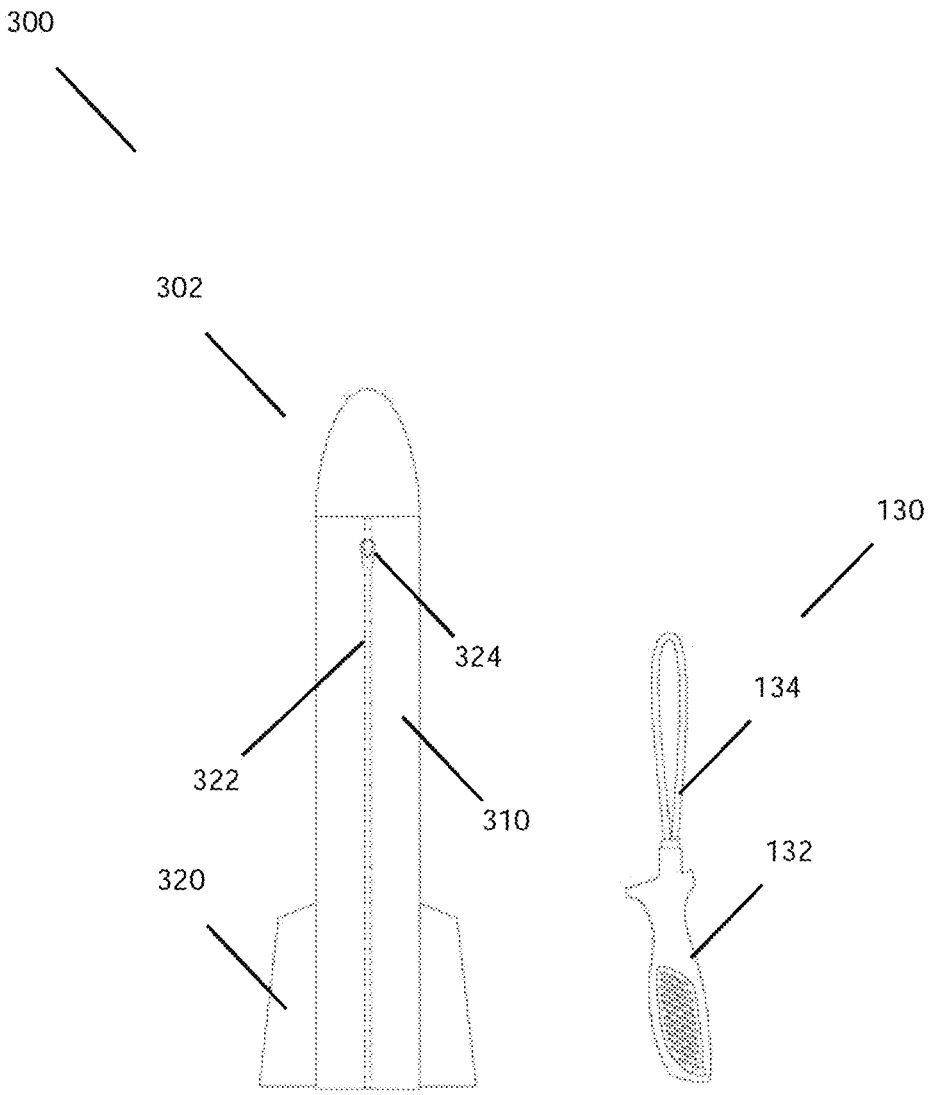
FIG. 8 shows a third representative embodiment inflatable launchable toy system with a launcher separate from an inflatable toy.

FIG. 8 shows a third representative embodiment inflatable launchable toy system 300. The third representative embodiment inflatable launchable toy system 300 comprises a third representative embodiment inflatable launchable toy 302 and the launcher 130 from the first embodiment system 100. The launcher 130 is held by a user who engages the third representative embodiment inflatable launchable toy 302 with the launcher 130 (see FIG. 9), pulls the inflatable launchable toy 302 away from the launcher 130 to increase tension (see FIG. 10), then releases the inflatable launchable toy 302, causing the tension to be converted to kinetic energy propelling the inflatable launchable toy 302 forward.

The third representative embodiment inflatable launchable toy 302 comprises an airtight outer fabric layer 310. Unlike the first representative embodiment inflatable launchable toy 102, the third representative embodiment inflatable launchable toy 302 does not have an inflatable bladder 106 inside the outer fabric layer 310. Instead, the airtight outer fabric layer 310 is itself an airtight bladder and has an internal cavity. The airtight fabric layer 310 comprises one or morel pieces of fabric sewn together. The fabric used for the airtight fabric layer 310 is a ripstop nylon that is substantially airtight, but in alternative embodiments may comprise other suitable materials. The third representative embodiment inflatable launchable toy 302 is shown in the shape of a rocket, it may be in many different shapes and styles, including but not limited to: rockets, planes, superhero figures. The shape of the airtight fabric layer 310 is what gives the third representative embodiment inflatable launchable toy 302 its geometry when inflated.

Figure 9:
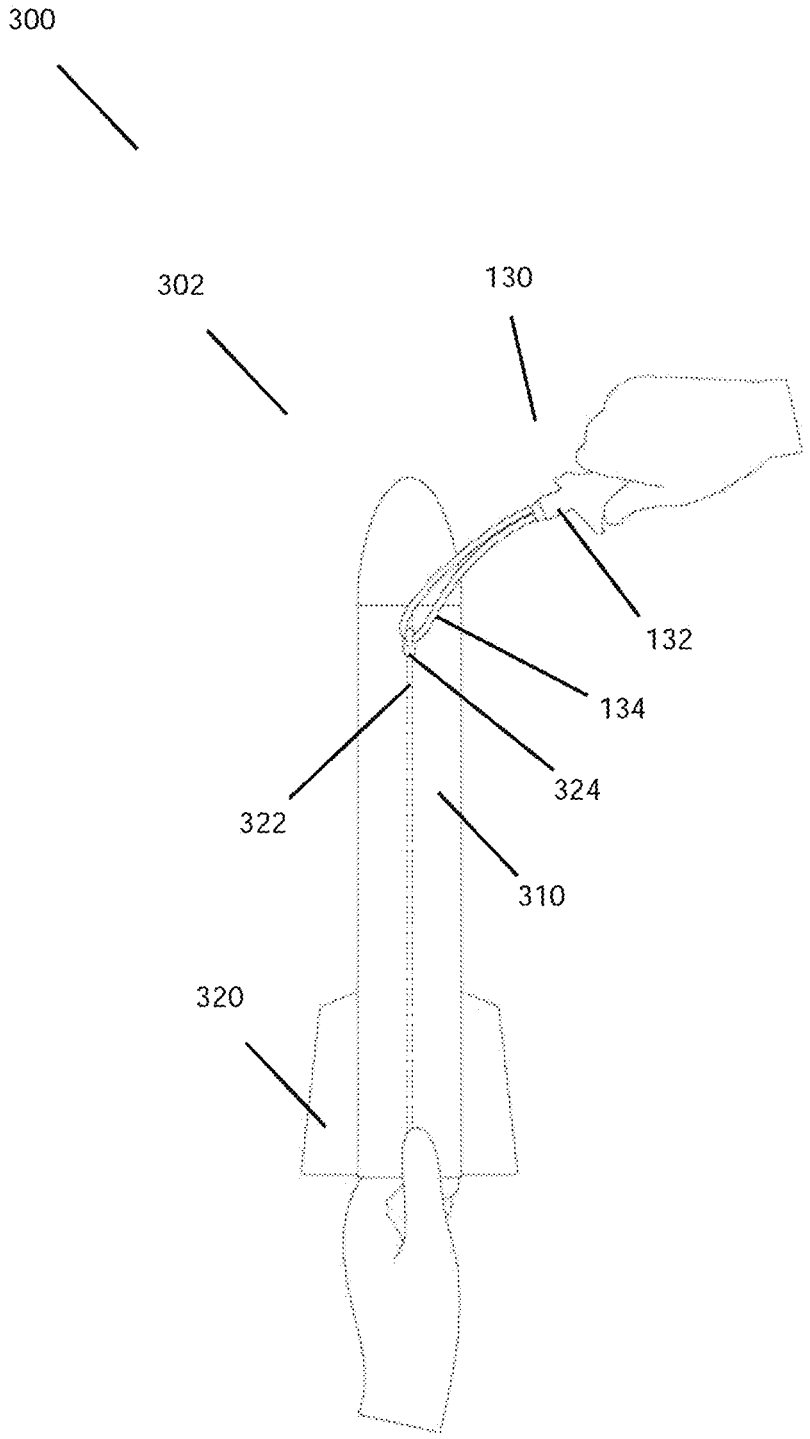
FIG. 9 shows the third representative embodiment inflatable launchable toy system with a launcher separate attached to the inflatable toy.
Figure 10:
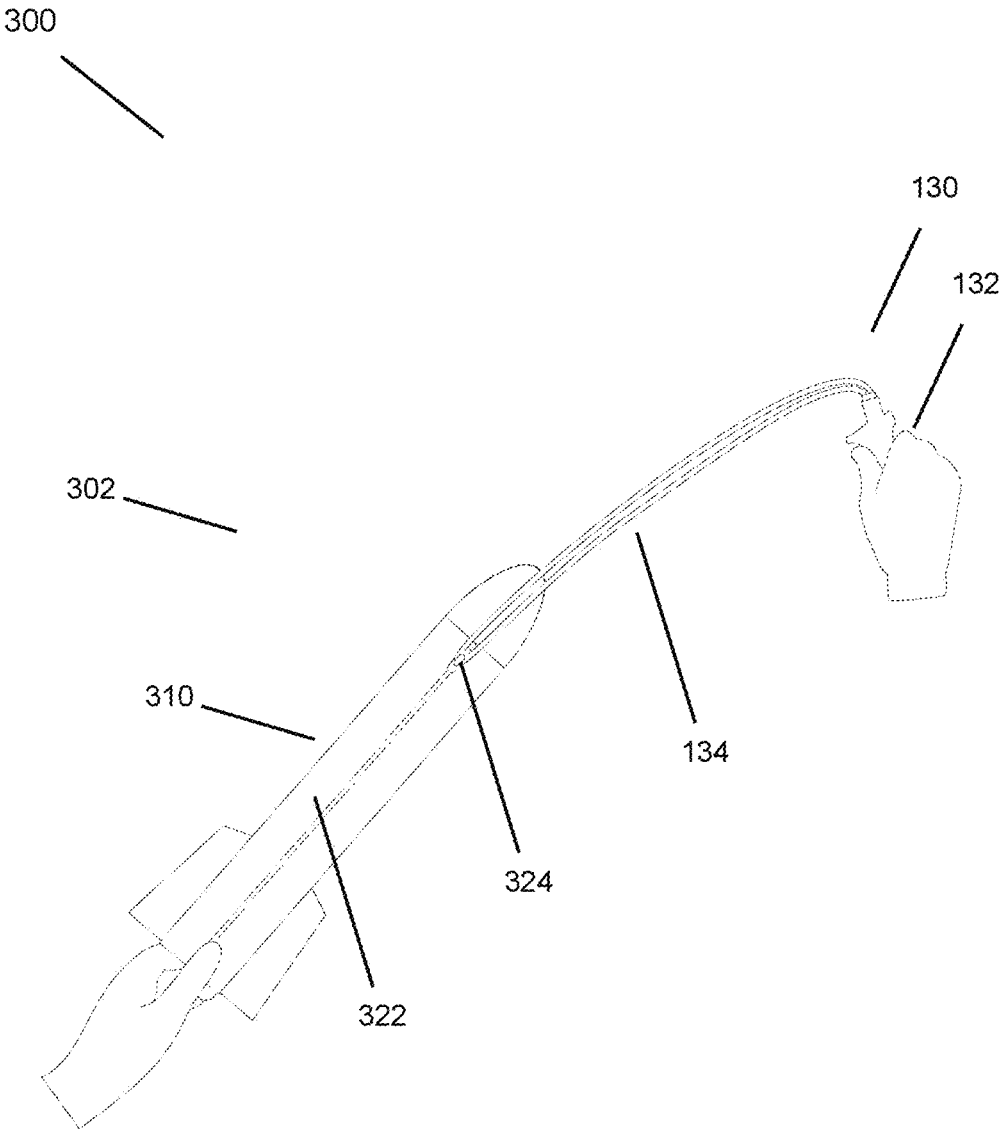
FIG. 10 shows the third representative embodiment inflatable launchable toy system with a launcher separate attached to the inflatable toy, with a launching elastic stretched in preparation for launch.

Similar to the first representative embodiment inflatable launchable toy 102, the third representative embodiment inflatable launchable toy 302 may have a foam nose cone 116, a weight 118 in or under the foam nose cone 116 to provide additional weight for improved flight stability, and a valve 108 for inflation and deflation (These features are not shown in FIGS. 8-10).

The third representative embodiment inflatable launchable toy 302 also has a plurality of fins 320. These fins 320 are typically light, stiff material that is either sewn into the airtight fabric layer 310 or attached to the airtight fabric layer 310. In either case, the fins 320 become part of the airtight fabric layer 310.

The airtight fabric layer 310 has at least one outer fabric seam 322 that joins the one or more pieces of the airtight fabric layer 310 with stitched thread, heat seal and/or glue. The joined edges of the airtight fabric layer 310 pieces are overlapped and folded one or more times. In some alternative embodiments, the joined edges of the airtight fabric layer 310 pieces are overlapped but not folded. The folding of the joined edges of the airtight fabric layer 310 pieces improves the airtightness of the outer fabric seam 322. The folding of the joined edges of the airtight fabric layer 310 pieces also improves the stiffness of the outer fabric seam 322. A seam sealer is applied to make the outer fabric seam 322 substantially airtight. However, in other embodiments, the outer fabric seam 322 is substantially airtight without seam sealer. In some alternative embodiments, the outer fabric seam has a strip of non-stretchable fabric coupled to the one or more pieces of the outer fabric layer 310.

The third representative embodiment inflatable launchable toy 302 has a launching hook 324 coupled to the airtight fabric layer 310 on the outer fabric seam 322 near the front of the third representative embodiment inflatable launchable toy 302 than the rear. In some alternative embodiments, the launching hook 324 is coupled to the airtight fabric layer 310, but not at the outer fabric seam 322. In such alternative embodiments, the airtight fabric layer 310 has sufficient stiffness to handle the tension from launching operation without damage or significant stretching. This likely requires a different type of airtight fabric layer 310 material or a thicker layer than if the launching hook 324 is placed on the outer fabric seam 322.

To launch the third representative embodiment inflatable launchable toy 302, a user takes the launcher 130 and attaches the launching elastic 134 to the launching hook 324 of the third representative embodiment inflatable launchable toy 302. The user than grasps the third representative embodiment inflatable launchable toy 302 near the rear, preferably on the outer fabric seam 322. The user then draws the third representative embodiment inflatable launchable toy 302 back and away from the launcher handle 132, stretching the launching elastic 134. The user then aims and releases the third representative embodiment inflatable launchable toy 302, which is accelerated by the energy stored in the launching elastic 134 and launched into flight.

What is claimed is:

1. An inflatable launchable toy system, comprising:

a launcher with a launcher handle and a launching elastic coupled to the launcher handle; and an inflatable launchable toy having an outer fabric layer that is airtight and a launching hook coupled to the outer fabric layer, the launching hook configured to detachably couple to the launching elastic.

2. The inflatable launchable toy system of claim 1, wherein the outer fabric layer has at least one outer fabric seam that joins one or more pieces of the outer fabric layer.

3. The inflatable launchable toy system of claim 2, wherein the outer fabric seam comprises a plurality of edges of the outer fabric layer that are overlapped.

4. The inflatable launchable toy system of claim 2, wherein the outer fabric seam comprises a plurality of edges of the outer fabric layer that are overlapped and folded.

5. The inflatable launchable toy system of claim 2, wherein the outer fabric seam comprises a plurality of edges of the outer fabric layer that are joined by heat sealing.

6. The inflatable launchable toy system of claim 2, wherein the outer fabric seam comprises a plurality of edges of the outer fabric layer that are joined by glue.

7. The inflatable launchable toy system of claim 2, wherein the outer fabric seam comprises a strip of non-stretchable fabric coupled to the one or more pieces of the outer fabric layer.

8. The inflatable launchable toy system of claim 1, configured such that when the launching elastic is connected to the launching hook, and a user pulls the inflatable launchable toy back away from the launcher handle, the outer fabric layer becomes stiff under tension.

9. The inflatable launchable toy system of claim 1, wherein the outer fabric layer when inflated gives an intended shape to the inflatable launchable toy.

10. The inflatable launchable toy system of claim 1, wherein the inflatable launchable toy has a foam nose cone positioned inside the outer fabric layer.

11. An inflatable launchable toy, comprising:

an outer fabric layer that is airtight; and a launching hook coupled to the outer fabric layer, the launching hook configured to detachably couple to an launching elastic of a launcher.

12. The inflatable launchable toy of claim 11, wherein the outer fabric layer has at least one outer fabric seam that joins one or more pieces of the outer fabric layer.

13. The inflatable launchable toy of claim 12, wherein the outer fabric seam comprises a plurality of edges of the outer fabric layer that are overlapped.

14. The inflatable launchable toy of claim 12, wherein the outer fabric seam comprises a plurality of edges of the outer fabric layer that are overlapped and folded.

15. The inflatable launchable toy of claim 12, wherein the outer fabric seam comprises a plurality of edges of the outer fabric layer that are joined by heat sealing.

16. The inflatable launchable toy of claim 12, wherein the launching elastic comprises an elastic cord.

17. The inflatable launchable toy of claim 12, wherein the outer fabric seam comprises a strip of non-stretchable fabric coupled to the one or more pieces of the outer fabric layer.

18. The inflatable launchable toy of claim 11, configured such that when the launching elastic is connected to the launching hook, and a user pulls the inflatable launchable toy back away from a handle of the launcher, the outer fabric layer becomes stiff under tension.

19. The inflatable launchable toy of claim 11, wherein the launching hook is coupled to the outer fabric layer nearer to a front end of the inflatable launchable toy than a rear end of the inflatable launchable toy.

20. The inflatable launchable toy of claim 11, wherein the inflatable launchable toy has a foam nose cone positioned inside the outer fabric layer.

* * * * *